US006098347A

United States Patent [19]

Jaeger et al.

[11] Patent Number: 6,098,347

[45] Date of Patent: Aug. 8, 2000

[54] METAL FRAMED GEODESIC STRUCTURE

[76] Inventors: Leroy L. Jaeger, 76 Jana Dr., Ponce Inlet, Fla. 32127; Thiele Wetzel, 580 Ballough Rd., Daytona Beach, Fla. 32114

[21] Appl. No.: 09/010,158

[22] Filed: Jan. 21, 1998

[51] Int. Cl.[7] ..... E04B 7/08

[52] U.S. Cl. ..... 52/81.3; 52/309.5; 52/582.1

[58] Field of Search ..... 52/81.1, 309.4, 52/309.5, 309.1, 582.1, 582.2

[56] References Cited

U.S. PATENT DOCUMENTS

| | | |
|---|---|---|
| 3,061,977 | 11/1962 | Schmidt . |
| 3,343,324 | 9/1967 | Gordon . |
| 3,740,903 | 6/1973 | Ahern . |
| 3,999,337 | 12/1976 | Tomassetti et al. . |
| 4,149,346 | 4/1979 | Belt . |
| 4,160,345 | 7/1979 | Nalick . |
| 4,611,441 | 9/1986 | Wickens . |
| 4,625,472 | 12/1986 | Busick . |
| 4,750,807 | 6/1988 | Chamayou dit Felix . |
| 5,732,518 | 3/1998 | Roberts ..... 52/81.1 |

*Primary Examiner*—Beth A. Stephan
*Attorney, Agent, or Firm*—Edward M. Livingston, Esq.

[57] ABSTRACT

A metal-framed geodesic structure (40) has pyramidal frames (1, 8, 12) made of sheet metal. Edges of the pentagonally pyramidal frames are positioned on top edges of rectangular base wall sections (14). The base wall sections are positioned uprightly and the pentagonally pyramidal frames are slanted radially inward towards a structural center about which the base wall sections and the pentagonally pyramidal frames are positioned circumferentially. Edges of the hexagonally pyramidal frames are positioned on top-corner edges of pentagonally pyramidal frames and slanted inward radially to positions of contact with edges of adjacent hexagonally pyramidal frames in a circumferential ring having a top pentagonally polyhedral center which can have skylights and a ventilation aperture (42) at its apex. While edges of the pentagonally pyramidal frames are being attached to edges of the hexagonally pyramidal frames, temporary positioning braces (45, 46) maintain the frames accurately and reliably in structural position.

23 Claims, 9 Drawing Sheets

FIG. 11
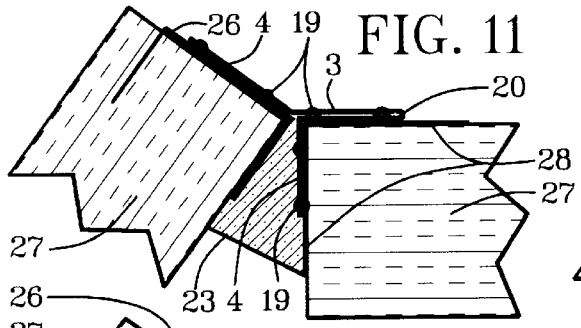
FIG. 12
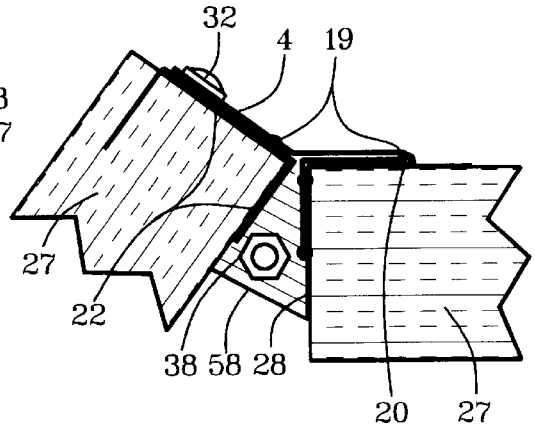
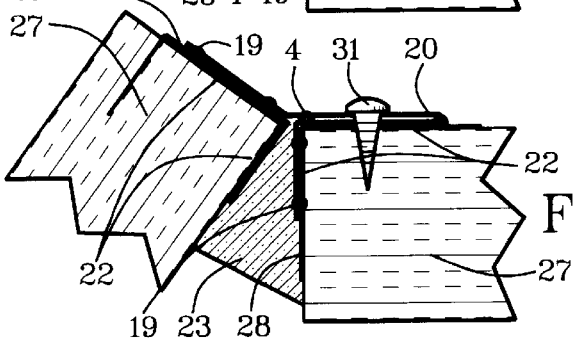
FIG. 13
FIG. 14
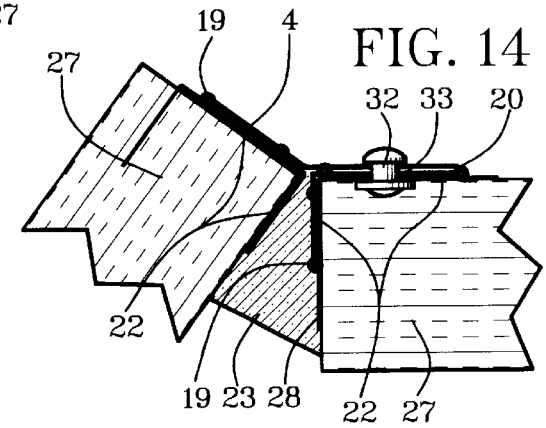
FIG. 15
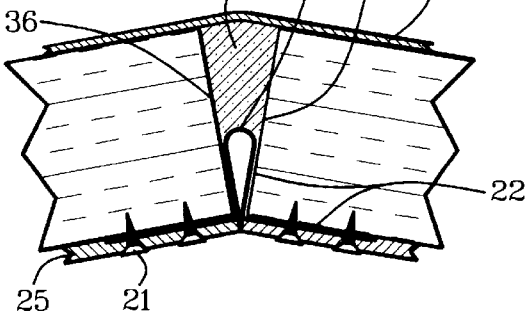
FIG. 16
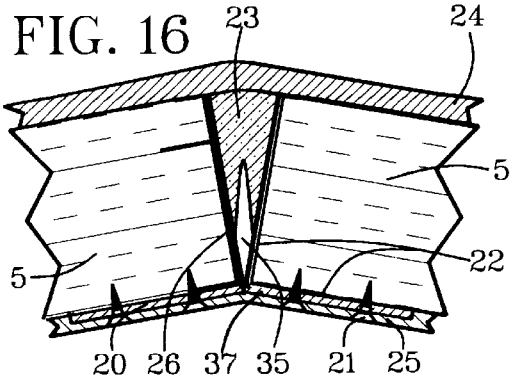
FIG. 17
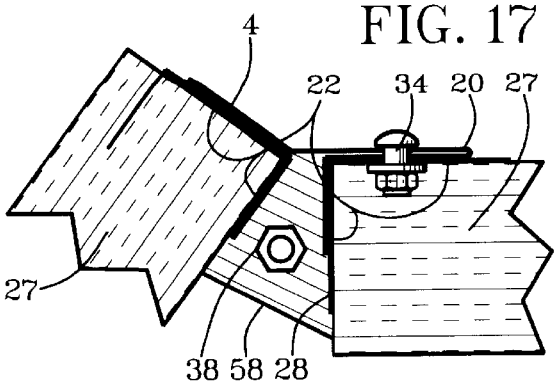

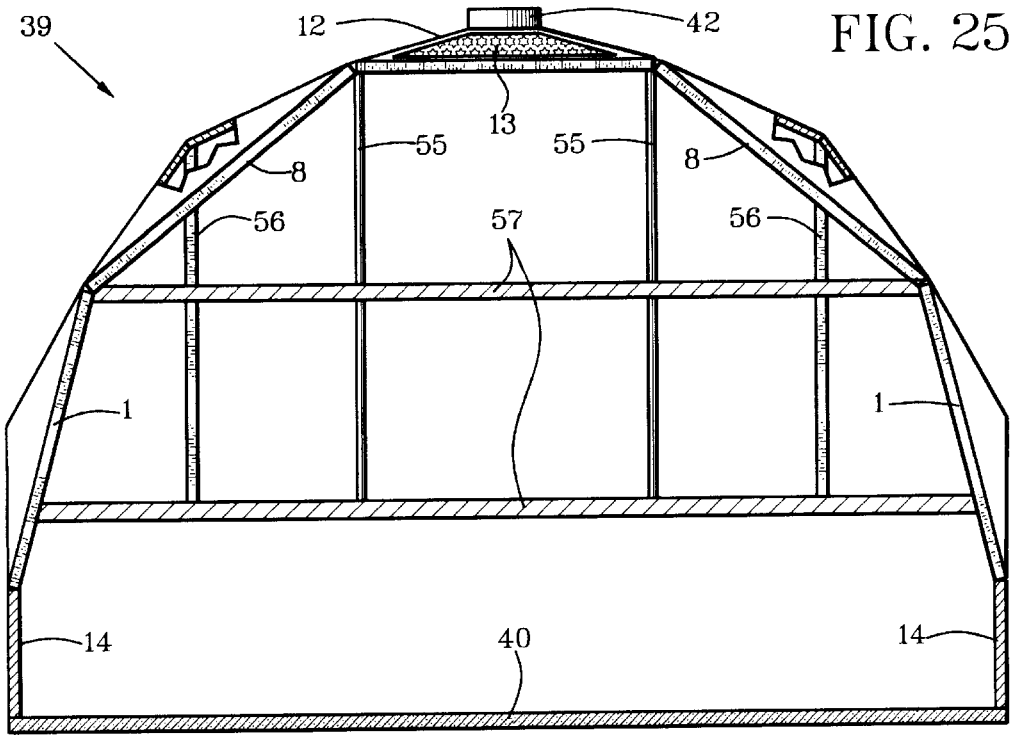
FIG. 25
FIG. 26
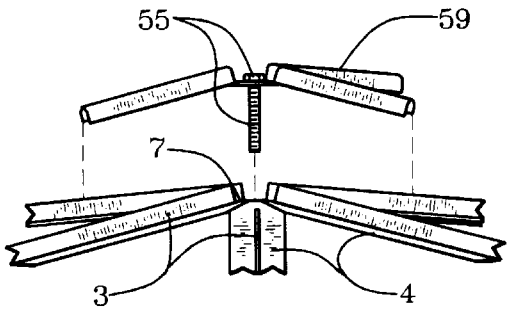
FIG. 27
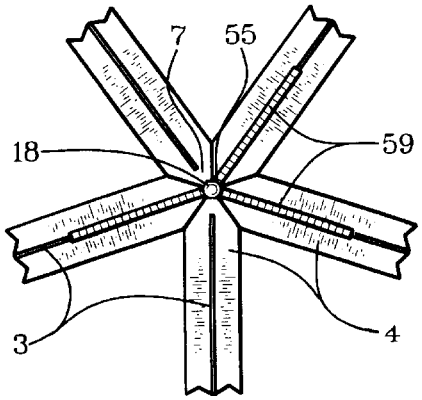

METAL FRAMED GEODESIC STRUCTURE

BACKGROUND OF THE INVENTION

This invention relates to geodesic structures and more particularly to a geodesic structure having pyramidal frames with metal-framed triangular components joined with sheet-metal joining means and assembled with temporary braces.

Geodesic structure has developed to include a variety of known forms and features since its introduction by Buckmeister Fuller and others. None, however, are known to have pentagonally and hexagonally pyramidal frames of metal that are attached with sheet-metal attachment extensions and positioned for construction with assembly braces in a manner taught by this invention.

Examples of different but related variations intended to employ advantageous characteristics of dome structure are described in the following patent documents. U.S. Pat. No. 4,750,807, issued to Chamayou dit Felix on Jun. 14, 1988, described a reticulation of arched polygonal elements for a curved motion-picture screen. U.S. Pat. No. 4,625,472, issued to Busick on Dec. 2, 1986, taught joining insulated panels with cementitious materials that were reinforced with wire mesh and supported on a framework while being assembled to form buildings. U.S. Pat. No. 4,611,441, issued to Wickens on Sep. 16, 1986, taught joining geodesic triangular units with metal straps in grooves. U.S. Pat. No. 4,160,345, issued to Nalick on Jul. 10, 1979, taught a geodesic structure having a combination of hexagonal and semi-hexagonal forms. U.S. Pat. No. 4,149,346, issued to Belt on Apr. 17, 1979, was limited to a triangular frame of three metallic channels having inwardly curled ends of channel walls. U.S. Pat. No. 3,999,337, issued to Tomassetti, Jr., et al. on Dec. 28, 1976, taught a domed structure of arched risers supported by a center post. U.S. Pat. No. 3,740,903, issued to Ahern on Jun. 26, 1973, taught flexible flaps with joining means on edges of panels.

Major problems with geodesic structure continue to exist. They are related primarily to joining angular forms and support of portions of geodesic structures during construction.

SUMMARY OF THE INVENTION

In light of these and other problems with conventional geodesic structure, objects of patentable novelty and utility taught by this invention are to provide a metal-framed geodesic structure which:

Does not require a support form during construction of geodesic buildings;

Allows quick and inexpensive construction of geodesic buildings;

Is sturdy and long lasting;

Allows use of a wide selection of foam, plastic, wood, fibrous and metallic materials for panel structure;

Provides convenient skylights, window and door structure; and

Has an optional top ventilating conveyance for air conditioning.

This invention accomplishes these and other objectives with a metal-framed geodesic structure having frames made of sheet metal. Triangular sections of the frames are joined at edges with sheet-metal fastening means to form pentagonally pyramidal frames and hexagonally pyramidal frames onto which triangular plates of desired building material are fastened with appropriate material-fastening means. Edges of five of the pentagonally pyramidal frames are positioned on top edges of five rectangular base-wall frames. The base-wall frames are positioned uprightly and the pentagonally pyramidal frames are slanted radially inward towards a structural center about which the base-wall frames and the pentagonally pyramidal frames are positioned circumferentially. Edges of five of the hexagonally pyramidal frames are positioned on top-corner edges of the five pentagonally pyramidal frames and slanted inward radially to positions of contact with edges of adjacent hexagonally pyramidal frames in a circumferential ring having a top pentagonally polyhedral center which can have skylights and a ventilation aperture at its apex. While edges of the pentagonally pyramidal frames are being attached to edges of the hexagonally pyramidal frames, positioning rods maintain the pentagonal frames and the hexagonal frames accurately and reliably in structural position. The positioning rods have bottom ends attached to a fastener bolt at the structural center and top ends attached to centers of the pentagonally pyramidal frames and the hexagonally pyramidal frames respectively.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF DRAWINGS

This invention is described by appended claims in relation to description of a preferred embodiment with reference to the following drawings which are described briefly as follows:

FIG. 11 is a side view of a section of two frame members attached with a sheet-metal extension having a metal-fold base with edge extensions welded to gussets on edges of the two frame members;

FIG. 12 is a top view of two base sections connected together and anchored to a structural base with fastening members, consisting of a base clip and a nut and bolt.

FIG. 13 is a side view of a section of two frame members attached with a sheet-metal extension having a metal-fold base with edge extensions screwed to a gusset on one of the two frame members in addition to being welded to gussets on edges of the two frame members;

FIG. 14 is a side view of a section of two frame members attached with a sheet-metal extension having a metal-fold base with edge extensions riveted to a gusset of one of the two frame members in addition to being welded to gussets on edges of the two frame members;

FIG. 15 is a partially cutaway side view of an angled attachment of two frame sections attached with sheet-metal attachment extensions in an inverted Y shape having a looped leg in combination with a metal strap, metal-screw fasteners and adhesive material;

FIG. 16 is the FIG. 15 illustration with addition of edge gussets to which a metal strap is riveted to an inside surface and wall covering is screwed to an inside surface;

FIG. 17 is the FIG. 14 illustration with a bolt and nut and with addition of an inside plate member and without weld attachment;

FIG. 25 is a vertical plan view of a geodesic structure having hanging supports of successive floor structure;

FIG. 26 is an exploded side view of a suspension support section of a hanging rod supported with sheet-metal extensions; and FIG. 27 is a top view of the suspension support section of FIG. 26 an attachment section of a hanging beam supported with sheet-metal extensions.

DESCRIPTION OF PREFERRED EMBODIMENT

Terms used to describe features of this invention are listed below with numbering in the order of their initial use with reference to the drawings. These terms and numbers assigned to them designate the same features wherever used throughout this description.

Figure 1:
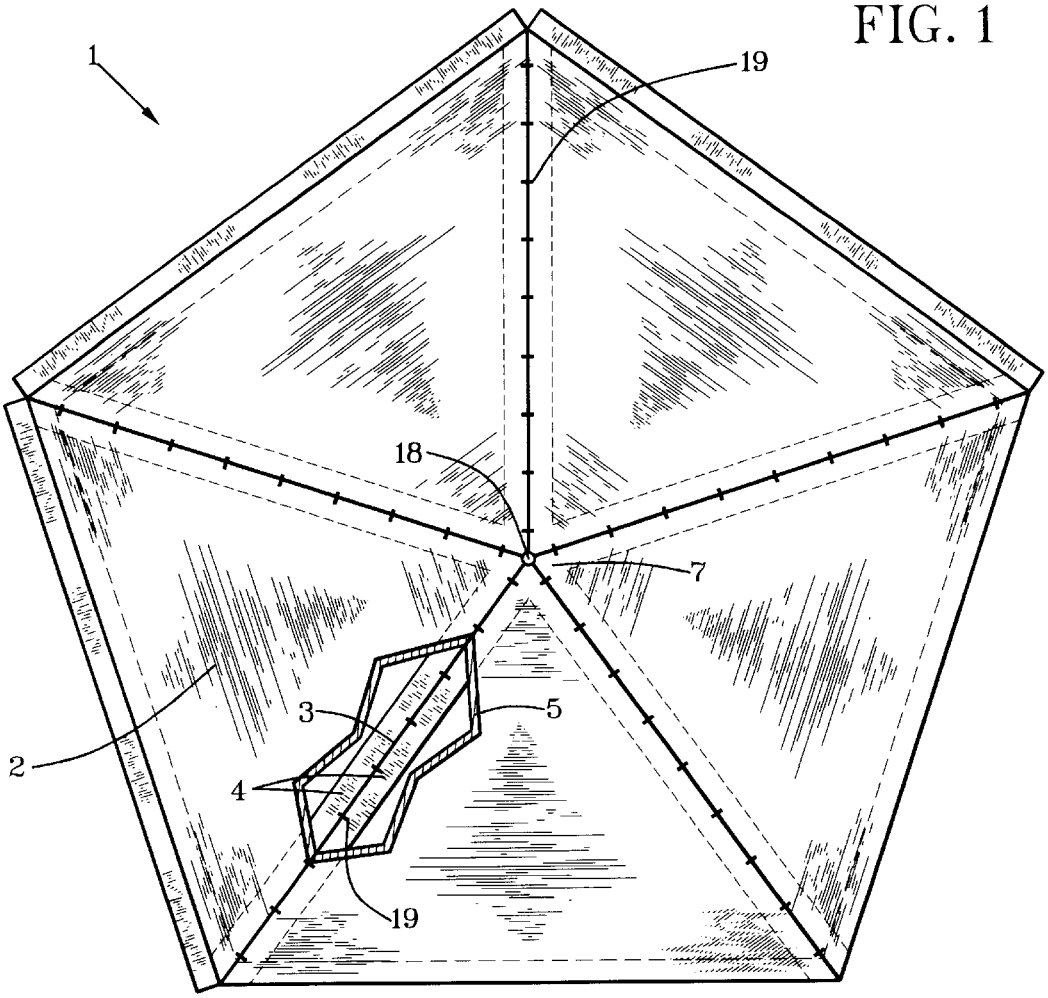
FIG. 1 is a partially cutaway top view of a pentagonally pyramidal frame.
Figure 2:
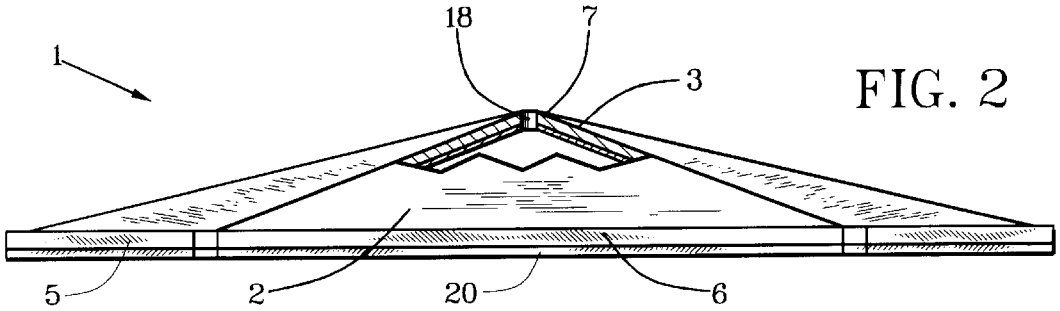
FIG. 2 is a partially cutaway side elevation view of the FIG. 1 illustration.

1. Pentagonally pyramidal frame
2. Pentagonally triangular sections
3. Sheet metal fold
4. Sheet-metal attachment extensions
5. Dome-wall material
6. Regular pentagonal base
7. Pentagonally pyramidal apex
8. Hexagonally pyramidal frame
9. Hexagonally triangular sections
10. Regular hexagonal base
11. Hexagonally pyramidal apex
12. Pentagonally pyramidal apex frame
13. Optional skylights
14. Base wall section
15. Wall section top edges -continued 16. Wall section bottom edges
17. Base wall section end
18. Fastener orifices
19. Welds
20. Sheet-metal frame
21. Fastener screws
22. Adhesive material
23. Foam-in-place material
24. Outside covering
25. Wall board
26. End channel
27. Wall material
28. Corner gusset
31. Sheet-metal screw
32. Rivet
33. Washer
34. Fastener bolt and nut
35. Metal loop
36. End walls
37. Corner strap
38. Fastening member — nut and bolt
39. Metal-framed geodesic structure
40. Polyhedral base
41. Flat plan view
42. Ventilation/skylight aperture
43. Structure access
44. Access-construction edges
45. Pentagonal-frame assembly brace
46. Hexagonal-frame assembly brace
47. Assembly-brace fastener
48. Temporary fastener bolt
52. Hydraulic lift
53. Apex-frame assembly brace
54. Mobile assembly-brace fastener
55. Suspension-support rods
56. Suspension-support member
57. Floors
58. Base clip
59. Metal suspension adaptors Reference is made first to FIGS. 1–2 of the drawings. A pentagonally pyramidal frame 1 has pentagonally triangular sections 2 that has sheet metal-frame 20 with sheet metal fold 3 having sheet-metal attachment extensions 4 to which dome-wall material 5 is attached. The pentagonally pyramidal frame 1 has a regular pentagonal base 6 and a pentagonally pyramidal apex 7.

Figure 3:
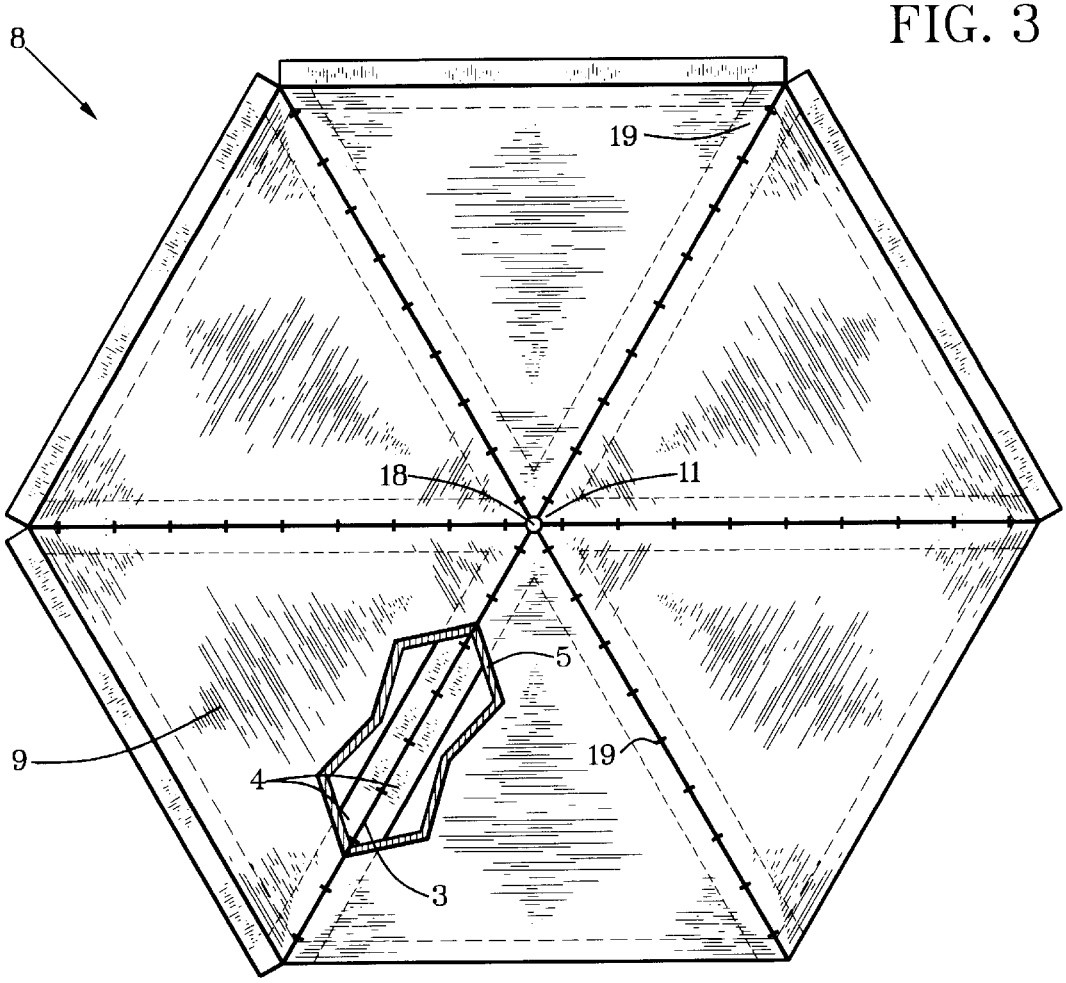
FIG. 3 is a partially cutaway top view of a hexagonally pyramidal frame.
Figure 4:
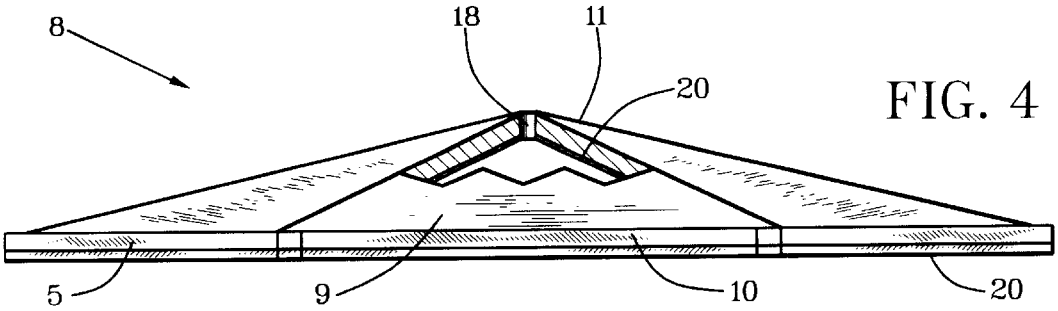
FIG. 4 is a partially cutaway side elevation view of the FIG. 3 illustration.

Referring to FIGS. 3–4, a hexagonally pyramidal frame 8 has hexagonally triangular sections 9 that are metal-framed with sheet metal fold 3 having sheet-metal attachment extensions 4 to which dome-wall material 5 is attached. The hexagonally pyramidal frame 8 has a regular hexagonal base 10 and a hexagonally pyramidal apex 11.

Figure 5:
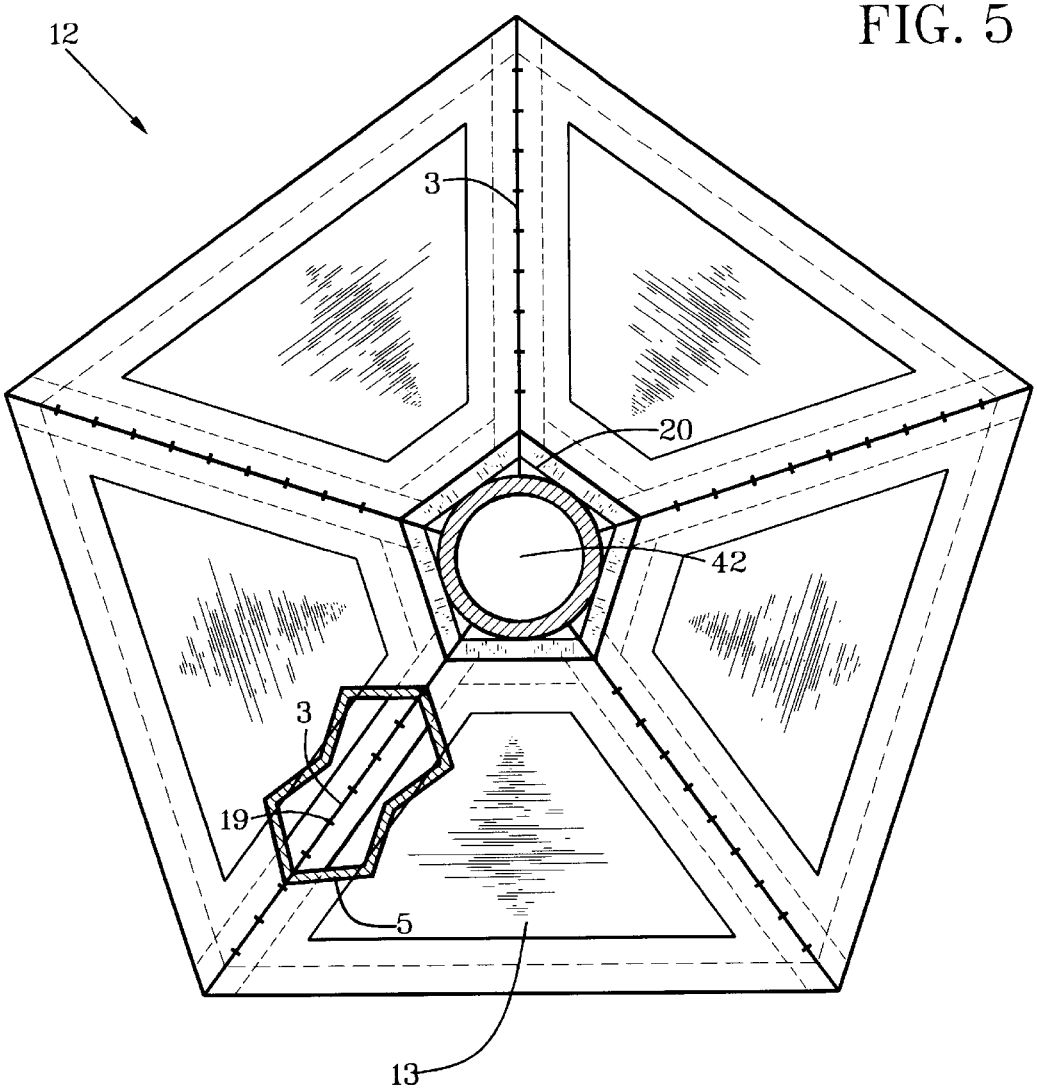
FIG. 5 is a partially cutaway top view of a pentagonally pyramidal apex frame.
Figure 6:
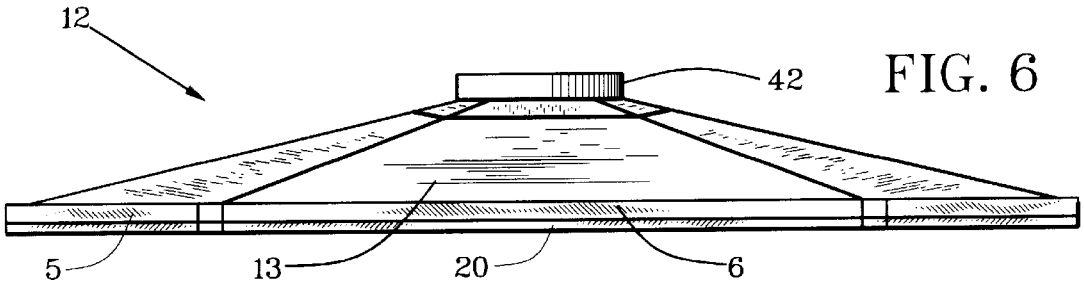
FIG. 6 side elevation view of the FIG. 5 illustration.

Referring to FIGS. 5–6, a pentagonally pyramidal apex frame 12 has pentagonally triangular sections 2 that are metal-framed with sheet metal folds 3 having sheet-metal attachment extensions 4 to which optional skylights 13 are attached. The pentagonally pyramidal apex frame 12 has a regular pentagonal base 6.

Figure 7:
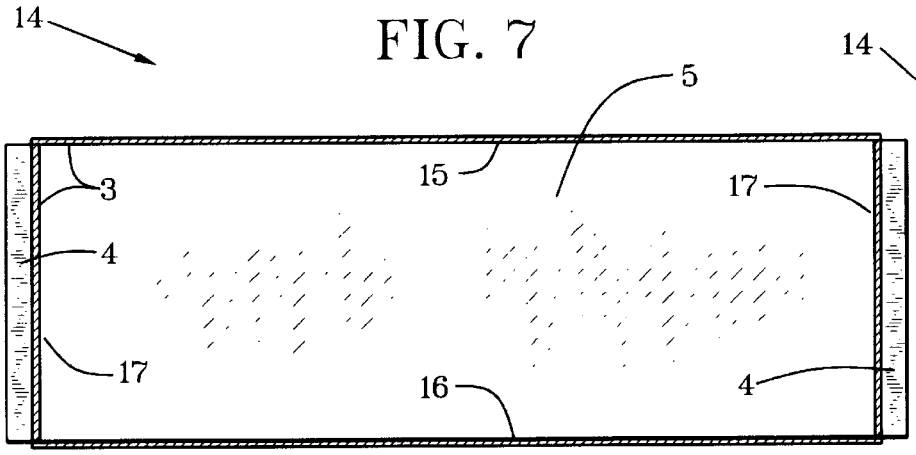
FIG. 7 is side plan elevation view of a base wall section.
Figure 8:
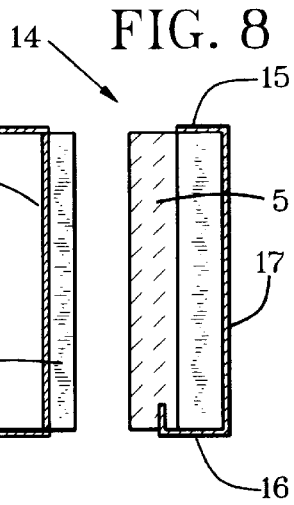
FIG. 8 is an end view of the FIG. 7 illustration.

Referring to FIGS. 7–8, a base wall section 14 made of dome-wall material 5 is framed with sheet metal fold 3 having sheet-metal attachment extensions 4. The base wall section 14 is generally rectangular with wall section top edges 15, wall section bottom edges 16 and base wall section end 17.

In FIGS. 1–8, the sheet metal fold 3 and the sheet-metal attachment extensions 4 illustrated are representative of a selection of sheet-metal forms, structure and attachments generally. Some are described in relation to FIGS. 11–17. Fastener screws 21, welds 19 sheet metal screws 31, rivets 32, and fastener nuts and bolts 34 indicate sheet-metal fastening means that can be employed. Also included are adhesive materials 22.

Figure 9:
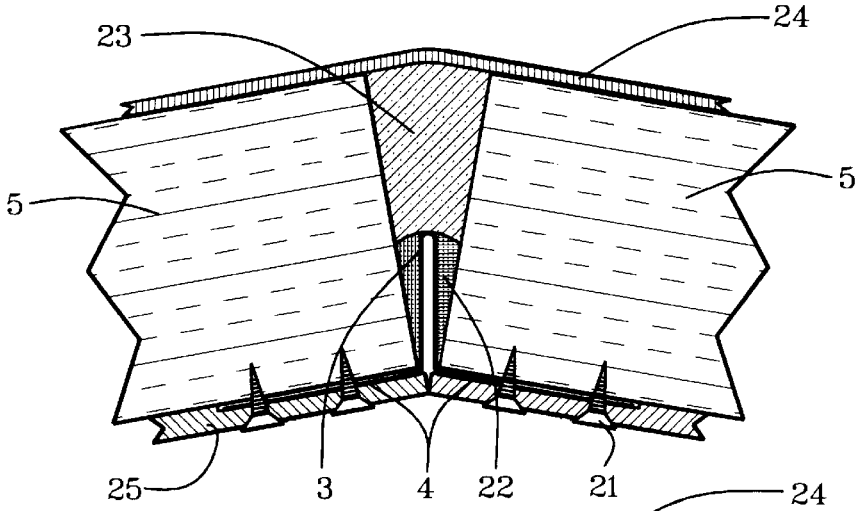
FIG. 9 is a partially cutaway side view of an angled attachment of two frame sections attached with sheet-metal attachment extensions from a metal fold in combination with a metal corner strap and metal-screw fasteners.

Referring to FIG. 9, structural forms of sheet metal folds 3 can include sheet-metal frame 20 with sheet-metal attachment extensions 4 through which fastener screws 21, welds or other fastener means can be screwed into dome-wall material 5 having appropriate material strength and consistency. Adhesive material 22, foam-in-place material 23 or other form-in-place material can be used in combination with outside covering 24 and wall board 25 for angled attachments with particular material selections.

Figure 10:
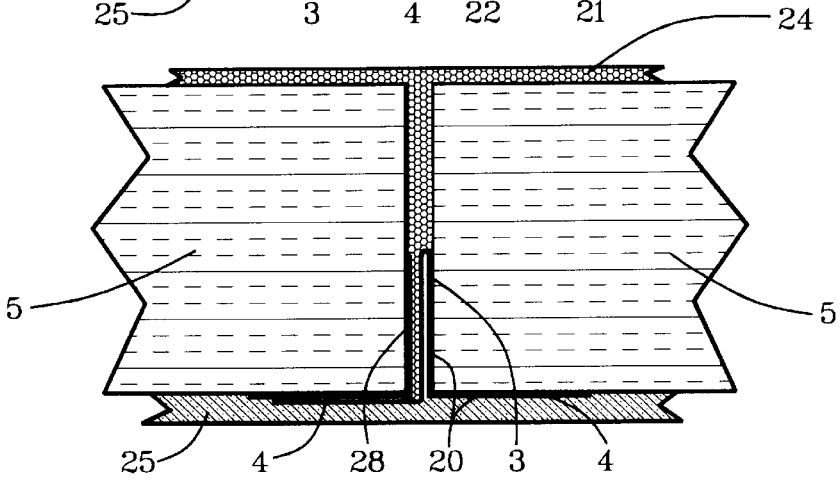
FIG. 10 is a partially cutaway side view of an in-line attachment of two frame sections attached with a sheet-metal extension from a metal fold in combination with a corner gusset, foam-in-place material and wall covering.
Figure 18:
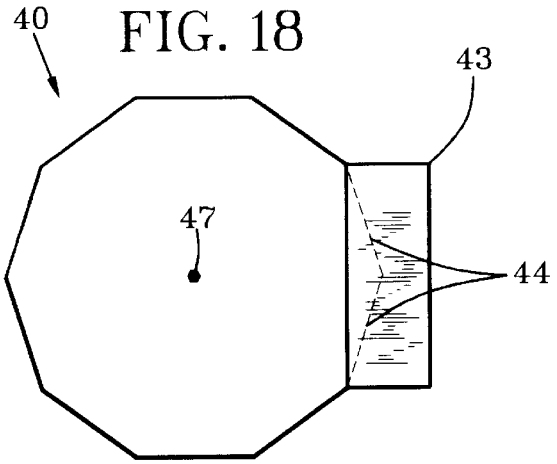
FIG. 18 is a top view of a polyhedral base with a central brace fastener.
Figure 19:
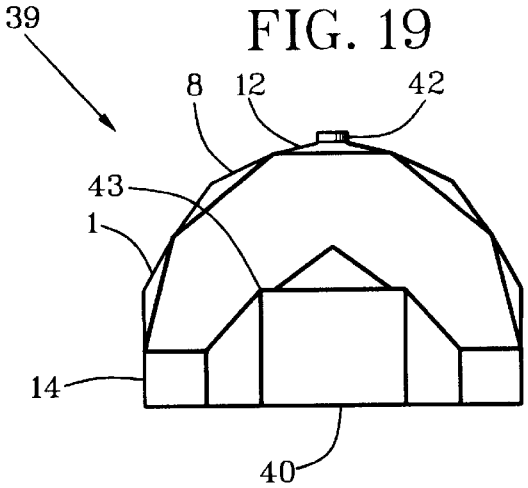
FIG. 19 is a front elevation view of a geodesic structure.
Figure 20:
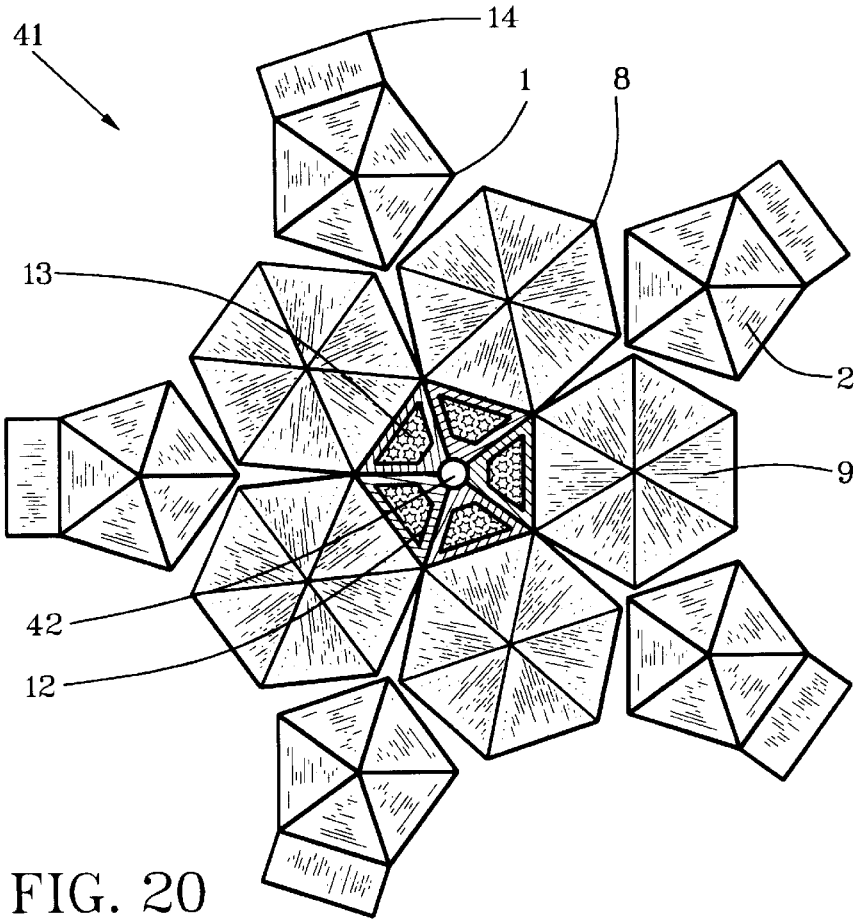
FIG. 20 is a flat plan view of arrangement of pentagonally pyramidal frames, hexagonally pyramidal frames and a pentagonally pyramidal apex frame.
Figure 21:
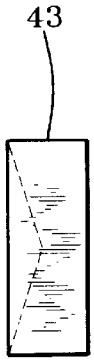
FIG. 21 is a top view of a structure access section.

Referring to FIG. 10, sheet-metal frame 20 can have sheet-metal attachment extensions 4 that are extended orthogonally for straight-wall attachments. Gussets 28 can be added as necessary for particular material requirements.

FIGS. 11–17 depict a selection of attachment formations for sheet metal fold 3 and sheet-metal attachment extensions 4 for constructing frames and geodesic structures with this invention. In FIG. 11, a sheet-metal fold 20 has sheet-metal attachment extensions 4 welded with welds 19 to an end gusset 26 on wall material 27 and welded with welds 19 to a corner gusset 28. The end gusset 26 and the corner gusset 28 can be glued to the wall material 27.

In FIG. 12, a wall material 27 with a corner gusset 28 is attached to an opposite side of the sheet-metal fold 3 of the FIG. 11 illustration.

In FIG. 13, a sheet-metal screw 31 is screwed through the corner gusset 28 and into the wall material 27 of the FIG. 11 illustration to enhance attachment strength for particular structural conditions.

In FIG. 14, a rivet 32 and a washer 33 are used in lieu of the sheet-metal screw 31 of the FIG. 13 illustration.

In FIG. 15, a metal loop 35 employs adhesive material 22 in contact with end walls 36 of the FIG. 9 illustration.

In FIG. 16, end channels 26 and a corner strap 37 are screwed on with fastener screws 21 for added structural integrity to the FIG. 15 illustration. The corner strap 37 is a form of sheet metal fold 3.

In FIG. 17, a fastener bolt and nut 34 are used optionally to the rivet 32 and washer 33 of the FIG. 14 illustration. Also, a fastening member, comprising a nut and bolt, 38 is attached to the wall material 27 of the FIG. 14 illustration for desired structural objectives.

Referring to FIGS. 18–21, a metal-framed geodesic structure 39 positioned on a polyhedral base 40 has five base wall sections 14 supporting five pentagonally pyramidal frames 1. Five hexagonally pyramidal frames 8 are positioned inwardly and upwardly from the pentagonally pyramidal frames 1 and a pentagonally pyramidal apex frame 12 is positioned at top center of the metal-framed geodesic structure 39. Outside edges of the pentagonally pyramidal frames 1 and outside edges of the hexagonally pyramidal frames 8 have lengths equal to lengths of the base wall sections 14 as depicted in a flat plan view 41.

Conventional geodesic structures are constructed using separate triangular sections whereas the present invention uses preassembled pentagonally frame sections 1 and hexagonally frame sections 8 that are metal framed with sheet metal fold 3 as taught by this invention.

Pyramidal heights of the pentagonally frame sections 1 and the hexagonally frame sections 8 can be different from each other and different for different structures for different design preferences and for different use conditions. The pyramidal heights are distances from the regular pentagonal bases 6 to pentagonally pyramidal apexes 7 and from the regular hexagonal bases 10 to the hexagonally pyramidal apexes 11 respectively.

The pentagonally pyramidal apex frame 12 can have a ventilation aperture 42 with sheet metal frame 20 as shown in FIGS. 5–6, 19–20, 23 and 25.

Structure accesses 43 comprising door framework and/or window framework are positioned preferably at select single or double access-construction edges 44 of the polyhedral base 40.

Figure 22:
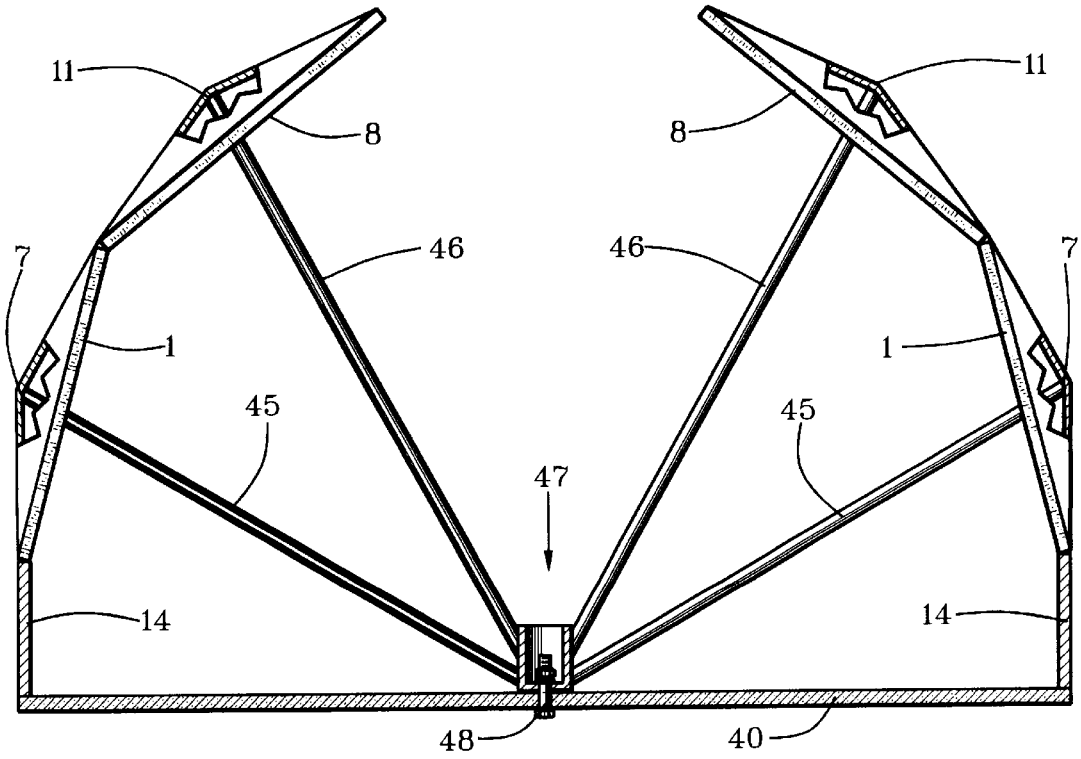
FIG. 22 is a partially cutaway side elevation view of oppositely disposed pentagonally pyramidal frames and hexagonally pyramidal frames supported by assembly-brace fasteners in a construction mode.

Referring to FIG. 22, pyramidal structure enhances structural integrity of frames in addition to facilitating positioning of the pentagonally pyramidal frames 1 with pentagonal-frame assembly braces 45 and the hexagonally pyramidal frames 8 with hexagonal-frame assembly braces 46 that are attached to an assembly-brace fastener 47 that is positioned proximate a structural center of the polyhedral base 40. The polyhedral base 40 can be structured of concrete that is preferably reinforced with steel or structural lumber. The assembly-brace fastener 47 can be a fastener bolt 48 to which the pentagonal-frame assembly braces 45 and the hexagonal-frame assembly braces 46 are fastened directly or can have wall structure also as depicted.

The pentagonal-frame assembly braces 45 and the hexagonal-frame assembly braces 46 are used dually for accurate positioning and for hoisting the pentagonally pyramidal frames 1 and the hexagonally pyramidal frames 8 to structural positions.

Figure 23:
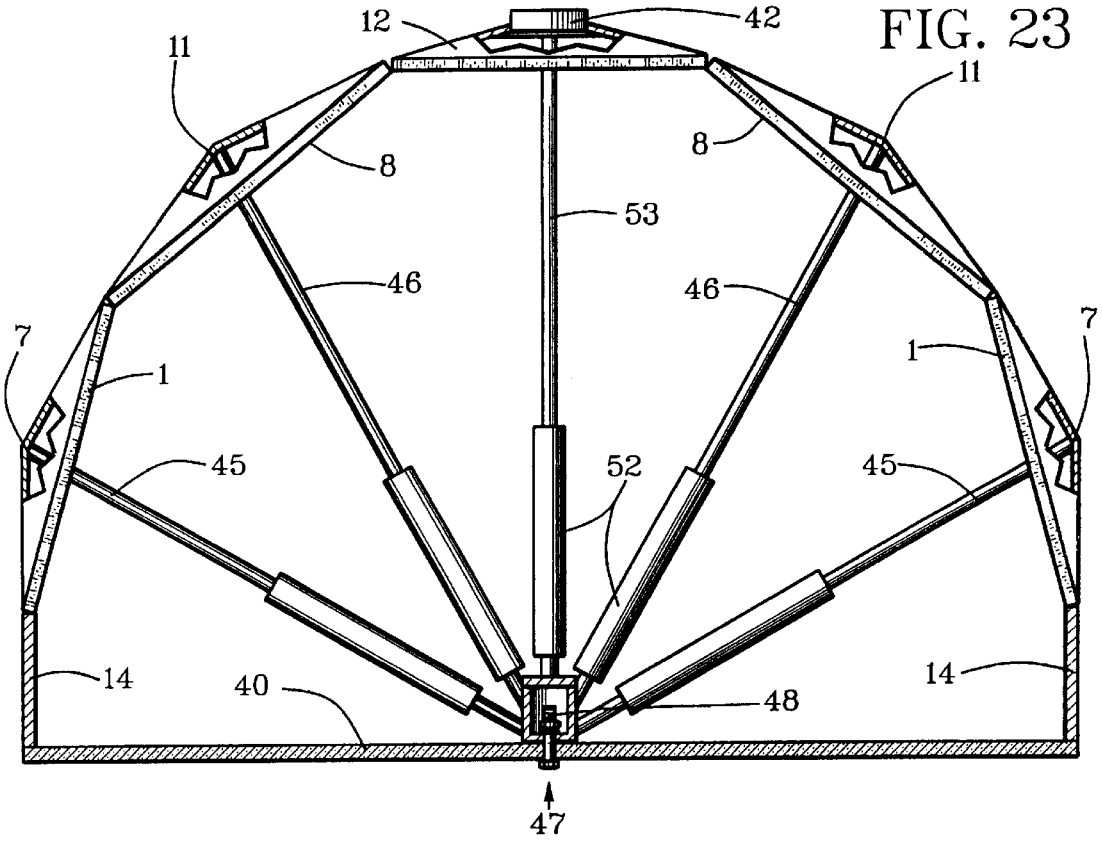
FIG. 23 is the FIG. 22 illustration with hydraulically expandable assembly-brace fasteners and with a pentagonally pyramidal apex frame in construction mode.

Referring to FIG. 23, hydraulic lifts 52 can be added to pentagonal-frame assembly braces 45 and to hexagonal-frame assembly braces 46 for ease of construction. Also, the pentagonally pyramidal apex frame 12 can lifted and positioned with an apex-frame assembly brace 53.

Figure 24:
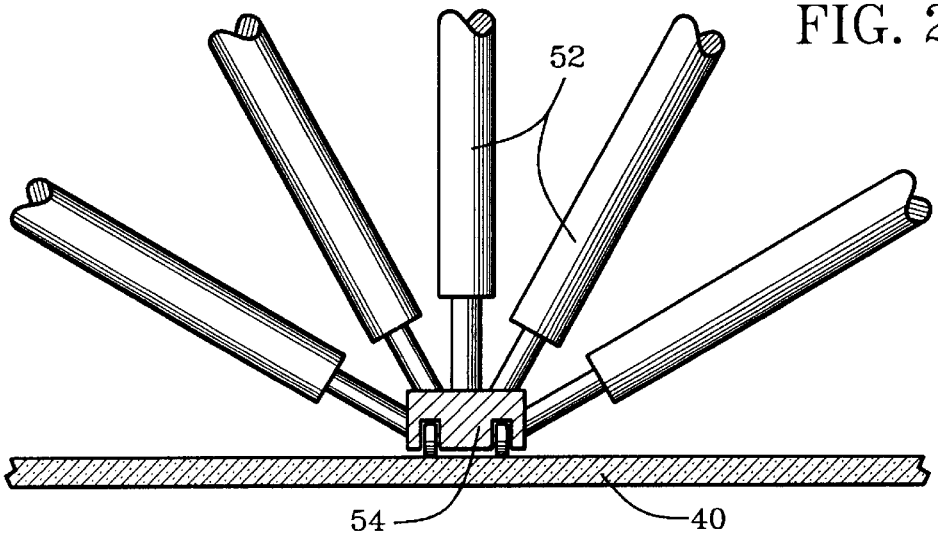
FIG. 24 is a partially cutaway end view of a mobile assembly-brace fastener from which hydraulic assembly braces are extended.

Referring to FIG. 24, a mobile assembly-brace fastener 54 can be employed for construction of metal-framed dome buildings that are elongate or variously irregular.

Referring to FIGS. 25–27, suspension-support rods 55 and suspension-support member 56 can be attached with sheet-metal frame 20, such as sheet metal folds 3 with extensions, using metal suspension adaptors 59 and other fastening means for support of floors 57, balconies and fixtures.

In addition to pentagonally and hexagonally pyramidal frames, other pyramidal frames also can be constructed with this invention. Particulary for elongate buildings, square pyramidal frames can be positioned on dome walls between parallel sides. Then at ends, half domes can be structured.

Practice of this invention, therefore, includes structure of a predetermined plurality of appropriate metal-framed pyramidal frames. An assembly-brace fastener 47 is positioned on a polyhedral base 40 and the pyramidal frames 1, 8, 12 and/or other frames are then positioned with the assembly braces 45, 46, 53 and other appropriate braces. All frames are fastened in construction positions with sheet-metal fastening means. Other construction work requiring positioning by such braces is completed. Then the braces are removed and finish work not requiring the braces is completed.

A new and useful metal-framed geodesic structure having been described, all such foreseeable modifications, adaptations, substitutions of equivalents, mathematical possibilities of combinations of parts, pluralities of parts, applications and forms thereof as described by the following claims and not precluded by prior art are included in this invention.

What is claimed is:

1. A metal-framed geodesic structure comprising:

a polyhedral base having five wall edges and five access-construction edges with lengths of the wall edges and lengths of the access-construction edges being equal to lengths of sides of a ten-sided polyhedron having a predetermined size;

the access-construction edges being interspersed separately between alternate wall edges of the polyhedral base and ends of wall edges intersect ends of access-construction edges;

the polyhedral base having a structural center that is equidistant from intersections of ends of the wall edges and ends of the access-construction sections;

five base wall sections that are metal-framed with sheet metal having sheet-metal attachment extensions;

the base wall sections being generally rectangular with lengths approximately equal to lengths of the wall edges of the polyhedral base and positioned uprightly with bottom edges proximate the wall edges of the polyhedral base;

five pentagonally pyramidal frames with pentagonal bases and having triangular sections that are metal-framed with sheet metal having sheet-metal attachment extensions;

the pentagonally pyramidal frames having base sides with lengths approximately equal to the lengths of the base wall sections;

the pentagonally pyramidal frames having base-wall sides oriented horizontally and positioned proximate top edges of the base wall sections of the polyhedral base with top corners of the pentagonally pyramidal frames slanted inwardly towards the structural center of the polyhedral base;

the pentagonally pyramidal frames having bottom-slope sides oriented upwardly and outwardly from the base wall section sides and having top-slope sides oriented upwardly and inwardly from top ends of the bottom-slope sides;

the pentagonally pyramidal frames having pyramidal apexes;

five hexagonally pyramidal frames with hexagonal bases and having triangular sections that are metal-framed with sheet metal having sheet-metal attachment extensions;

the hexagonally pyramidal frames having base sides with lengths approximately equal to the lengths of the base wall sections and the pentagonal pyramidal frames;

the hexagonally pyramidal frames having pyramidal axes coaxial with pyramidal apexes that are extended outwardly and upwardly from intersections of the pyramidal axes with the structural center of the polyhedral base;

the hexagonally pyramidal frames being positioned in a contiguous ring of hexagonally pyramidal frames;

the hexagonally pyramidal frames having top-slope sides proximate top-slope sides of adjacent hexagonally pyramidal frames in the contiguous ring of hexagonally pyramidal frames;

the hexagonally pyramidal frames having bottom-slope sides proximate the top-slope sides of the pentagonally pyramidal frames;

the hexagonally pyramidal frames having base sides oriented horizontally proximate top sides of access-construction sections vertically above the access-construction edges of the polyhedral base;

the hexagonally pyramidal frames having apex-support sides; and a pentagonally pyramidal apex frame having apex-base sides proximate the apex-support sides of the hexagonally pyramidal frames.

2. A metal-framed geodesic structure as described in claim 1 wherein:

a base-wall material is attached to the sheet-metal attachment extensions or anchor bolts of the base wall sections;

a dome-wall material is attached to the sheet-metal attachment extensions of the pentagonally pyramidal frames;

a dome-wall material is attached to the sheet-metal attachment extensions of the hexagonally pyramidal frames; and an apex-wall material is attached to the pentagonally pyramidal apex frame.

3. A metal-framed geodesic structure as described in claim 2 further comprising:

metal gussets attached to the base-wall material, the dome-wall material and the apex-wall material selectively for support of sheet-metal fastener extensions and sheet-metal fastener components.

4. A metal-framed geodesic structure as described in claim 2 further comprising:

metal straps fastened to predetermined attachments of adjacent frames of the metal-framed geodesic structure.

5. A metal-framed geodesic structure as described in claim 1 wherein:

the sheet-metal attachment sections include predetermined shapes, bends, folds and structure of sheet metal selectively for particular sheet-metal fabrication.

6. A metal-framed geodesic structure as described in claim 1 wherein:

the pentagonally pyramidal apex frame has a ventilation aperture and skylights.

7. A metal-framed geodesic structure as described in claim 1 wherein:

adjacent sheet-metal attachment extensions are fastened with rivets in matching fastener orifices of the adjacent sheet-metal attachment extensions.

8. A metal-framed geodesic structure as described in claim 1 wherein:

adjacent sheet-metal attachment extensions are fastened with machine-threaded fastener bolts in matching fastener orifices of the adjacent sheet-metal attachment extensions and machine-threaded fastener nuts are screwed onto the machine-threaded fastener bolts.

9. A metal-framed geodesic structure as described in claim 1 wherein:

the sheet-metal attachment extensions are fastened to adjacent sheet-metal attachment extensions of select frames with weldments.

10. A metal-framed geodesic structure as described in claim 7 wherein:

the sheet-metal attachment extensions are fastened to adjacent sheet-metal attachment extensions of select frames with weld also.

11. A metal-framed geodesic structure as described in claim 8 wherein:

the sheet-metal attachment extensions are fastened to adjacent sheet-metal attachment extensions of select frames with weld also.

12. A metal-framed geodesic structure as described in claim 1 further comprising:

an assembly-brace fastener positioned proximate the structural center of the polyhedral base in a construction mode.

13. A metal-framed geodesic structure as described in claim 12 further comprising:

pentagonal-frame assembly braces having predetermined lengths with bottom ends fastened to the assembly-brace fastener and top ends fastened to the pyramidal apexes of the pentagonally pyramidal frames in a construction mode.

14. A metal-framed geodesic structure as described in claim 12 further comprising:

hexagonal-frame assembly braces having predetermined lengths with bottom ends fastened to the assembly-brace fastener and top ends fastened to the pyramidal apexes of the hexagonally pyramidal frames.

15. A metal-framed geodesic structure as described in claim 14 further comprising:

pentagonal-frame assembly braces having predetermined lengths with bottom ends fastened to the assembly-brace fastener and top ends fastened to the pyramidal apexes of the pentagonally pyramidal frames.

16. A metal-framed geodesic structure as described in claim 1 wherein:

the polyhedral base is a concrete slab to which the base wall sections are attached to the sheet-metal attachment extensions of the base wall sections with metal fasteners or anchor bolts.

17. A metal-framed geodesic structure as described in claim 1 further comprising:

suspension supports affixed to predetermined portions of the pentagonally pyramidal frames and the hexagonally pyramidal frames selectively for suspension structural components of the metal-framed geodesic structure.

18. A metal-framed geodesic structure as described in claim 1 further comprising:

metal interconnects positioned between adjacent metal components of the metal-framed geodesic structure.

19. A method comprising the following steps for constructing a metal-framed geodesic structure:

producing a plurality of at least five pentagonally pyramidal frames that are sheet-metal framed and have pyramidal apexes;

producing a plurality of at least five hexagonally pyramidal frames that are sheet-metal framed and have pyramidal apexes;

producing a plurality of at least five base wall sections;

producing at least one pentagonally pyramidal apex frame;

producing structure access components;

building a polyhedral base having five wall edges and five access-construction edges with lengths of the wall edges and lengths of the access-construction edges being equal to lengths of sides of a ten-sided polyhedron having a predetermined size;

providing an assembly-brace fastener proximate a central section of the polyhedral base;

providing five pentagonal-frame assembly braces having predetermined lengths between positions of attachment of bottom ends to the assembly-brace fastener and a position of attachment of top ends to the pyramidal apexes of the pentagonally pyramidal frames with the pentagonally pyramidal frames in positions of assembly of the metal-framed geodesic structure;

providing five hexagonal-frame assembly braces having predetermined lengths between positions of attachment of bottom ends to the assembly-brace fastener and a position of attachment of top ends to the pyramidal apexes of the hexagonally pyramidal frames with the hexagonally pyramidal frames in positions of assembly of the metal-framed geodesic structure;

positioning five base-wall frames with bottom edges proximate base-wall edges of the polyhedral base;

positioning bottom-outside edges of the five pentagonally pyramidal frames proximate top-outside edges of the five base-wall frames and slanting the five pentagonally pyramidal frames inwardly to positions of assembly of the metal-framed geodesic structure;

positioning five pentagonal-frame assembly braces with bottom ends fastened to the assembly-brace fastener and top ends fastened to the pyramidal apexes of the five pentagonally pyramidal frames;

positioning five hexagonal-frame assembly braces with bottom ends fastened to the assembly-brace fastener and top ends fastened to the pyramidal apexes of the five hexagonally pyramidal frames;

positioning the five hexagonally pyramidal frames in a predetermined inwardly slanting orientation with top-slope sides proximate top-slope sides of adjacent hexagonally pyramidal frames in a contiguous rings of the hexagonally pyramidal frames, with bottom-slope sides proximate the top-slope sides of the pentagonally pyramidal frames, with base sides oriented horizontally proximate access-construction sections, and with apex-support sides oriented horizontally in positions of assembly of the metal-framed geodesic structure;

the five pentagonal-frame assembly braces and the five hexagonal-frame assembly braces being used dually as measuring instruments to assure accuracy of structural positioning and as temporary supports of the five pentagonally pyramidal frames and of the five hexagonally pyramidal frames during construction;

fastening all adjoining edges of the five pentagonally pyramidal frames, the five hexagonally pyramidal frames and the five base-wall frames and structure access sections, respectively;

attaching the pentagonally pyramidal apex frame to the top sides of the five hexagonally pyramidal frames;

completing all work on the metal-framed geodesic structure which requires support of the five pentagonal-frame assembly braces and the five hexagonal-frame assembly braces;

removing all hexagonal-frame and pentagonal-frame assembly braces; and completing all other work on the metal-framed geodesic structure.

20. A method comprising the following steps for constructing a metal-framed dome structure:

producing a predetermined plurality of pyramidal frames that are sheet-metal framed and have pyramidal apexes;

producing a predetermined plurality of base wall sections;

building a dome-structure base having a predetermined size and shape for the metal-framed dome structure;

providing an assembly-brace fastener proximate a center of the dome-structure base;

providing assembly braces having predetermined lengths between a position of attachment of bottom ends to the assembly-brace fastener and a position of attachment of top ends to the pyramidal apexes of the pyramidal frames with the pyramidal frames in positions of assembly of the metal-framed dome structure;

positioning base-wall frames with bottom edges proximate base-wall edges of the dome-structure base;

positioning bottom-outside edges of the pyramidal frames proximate top edges of the base-wall frames and slanting the pyramidal frames inwardly to positions of assembly of the metal-framed dome structure;

positioning the assembly braces with bottom ends fastened to the assembly-brace fastener and top ends fastened to the pyramidal apexes of the pyramidal frames;

the assembly braces being used dually as measuring instruments to assure accuracy of structural positioning and as temporary supports of the pyramidal frames in structural positions during construction;

fastening all adjoining edges of the pyramidal frames and the base-wall frames respectively;

completing all work on the metal-framed dome structure which requires support of the assembly braces;

removing all assembly braces; and completing all other work on the metal-framed dome structure.

21. A method comprising the following steps for constructing a metal-framed dome structure:

producing a predetermined plurality of pyramidal frames that are sheet-metal framed and have pyramidal apexes;

producing a predetermined plurality of base wall sections;

building a dome-structure base having a predetermined size and shape for the metal-framed dome structure;

providing an assembly-brace fastener proximate a center of the dome-structure base;

providing assembly braces having predetermined lengths between a position of attachment of bottom ends to the assembly-brace fastener and a position of attachment of top ends to the pyramidal apexes of the pyramidal frames with the pyramidal frames in positions of assembly of the metal-framed dome structure;

positioning base-wall frames with bottom edges proximate base-wall edges of the dome-structure base;

positioning bottom-outside edges of the pyramidal frames proximate top edges of the base-wall frames and slanting the pyramidal frames inwardly to positions of assembly of the metal-framed dome structure;

positioning the assembly braces with bottom ends fastened to the assembly-brace fastener and top ends fastened to the pyramidal apexes of the pyramidal frames;

the assembly braces being used dually as measuring instruments to assure accuracy of structural positioning and as temporary supports of the pyramidal frames in structural positions during construction;

fastening all adjoining edges of the pyramidal frames and the base-wall frames, respectively;

completing all work on the metal-framed dome structure which requires support of the assembly braces;

removing all assembly braces; and completing all other work on the metal-framed dome structure, wherein the metal-framed dome structure is circumferential with segmental base wall sections and the assembly braces are employed to assure accurate positioning and to support the pyramidal frames for predetermined positioning.

22. A method comprising the following steps for constructing a metal-framed dome structure:

producing a predetermined plurality of pyramidal frames that are sheet-metal framed and have pyramidal apexes;

producing a predetermined plurality of base wall sections;

building a dome-structure base having a predetermined size and shape for the metal-framed dome structure;

providing an assembly-brace fastener proximate a center of the dome-structure base;

providing assembly braces having predetermined lengths between a position of attachment of bottom ends to the assembly-brace fastener and a position of attachment of top ends to the pyramidal apexes of the pyramidal frames with the pyramidal frames in positions of assembly of the metal-framed dome structure;

positioning base-wall frames with bottom edges proximate base-wall edges of the dome-structure base;

positioning bottom-outside edges of the pyramidal frames proximate top edges of the base-wall frames and slanting the pyramidal frames inwardly to positions of assembly of the metal-framed dome structure;

positioning the assembly braces with bottom ends fastened to the assembly-brace fastener and top ends fastened to the pyramidal apexes of the pyramidal frames;

the assembly braces being used dually as measuring instruments to assure accuracy of structural positioning and as temporary supports of the pyramidal frames in structural positions during construction;

fastening all adjoining edges of the pyramidal frames and the base-wall frames respectively;

completing all work on the metal-framed dome structure which requires support of the assembly braces;

removing all assembly braces; and completing all other work on the metal-framed dome structure, wherein the assembly braces have selectively extendible lengths and the pyramidal frames are hoisted to predetermined positions where they are maintained by the assembly braces during fastening and assembly of the metal-framed dome structure.

23. A method comprising the following steps for constructing a metal-framed dome structure:

producing a predetermined plurality of pyramidal frames that are sheet-metal framed and have pyramidal apexes;

producing a predetermined plurality of base wall sections;

building a dome-structure base having a predetermined size and shape for the metal-framed dome structure;

providing an assembly-brace fastener proximate a center of the dome-structure base;

providing assembly braces having predetermined lengths between a position of attachment of bottom ends to the assembly-brace fastener and a position of attachment of top ends to the pyramidal apexes of the pyramidal frames with the pyramidal frames in positions of assembly of the metal-framed dome structure;

positioning base-wall frames with bottom edges proximate base-wall edges of the dome-structure base;

positioning bottom-outside edges of the pyramidal frames proximate top edges of the base-wall frames and slanting the pyramidal frames inwardly to positions of assembly of the metal-framed dome structure;

positioning the assembly braces with bottom ends fastened to the assembly-brace fastener and top ends fastened to the pyramidal apexes of the pyramidal frames;

the assembly braces being used dually as measuring instruments to assure accuracy of structural positioning and as temporary supports of the pyramidal frames in structural positions during construction;

fastening all adjoining edges of the pyramidal frames and the base-wall frames respectively;

completing all work on the metal-framed dome structure which requires support of the assembly braces; removing all assembly braces;

completing all other work on the metal-framed dome structure; and positioning the mobile assembly-brace fastener selectively between edges of predetermined shapes of metal-framed dome structures, wherein the assembly-brace fastener is a mobile assembly-brace fastener.

* * * * *